US010734711B2

(12) United States Patent
Schlosser

(10) Patent No.: US 10,734,711 B2
(45) Date of Patent: Aug. 4, 2020

(54) SHAFT ANTENNA SYSTEM FOR MOBILE COMMUNICATION

(71) Applicant: KATHREIN-WERKE KG, Rosenheim (DE)

(72) Inventor: Maximilian Schlosser, Rosenheim (DE)

(73) Assignee: KATHREIN-WERKE KG, Rosenheim (DE)

( * ) Notice: Subject to any disclaimer, the term of this patent is extended or adjusted under 35 U.S.C. 154(b) by 0 days.

(21) Appl. No.: 16/076,837

(22) PCT Filed: Feb. 14, 2017

(86) PCT No.: PCT/EP2017/053202
§ 371 (c)(1),
(2) Date: Aug. 9, 2018

(87) PCT Pub. No.: WO2017/140639
PCT Pub. Date: Aug. 24, 2017

(65) Prior Publication Data

US 2019/0051974 A1 Feb. 14, 2019

(30) Foreign Application Priority Data

Feb. 15, 2016 (DE) ..... 20 2016 100 765

(51) Int. Cl.
*H01Q 1/24* (2006.01)
*H01Q 1/12* (2006.01)
*H01Q 1/04* (2006.01)

(52) U.S. Cl.
CPC ..... *H01Q 1/246* (2013.01); *H01Q 1/04* (2013.01); *H01Q 1/1207* (2013.01)

(58) Field of Classification Search
CPC ..... H01Q 1/04; H01Q 1/1207; H01Q 1/246; H01Q 1/2233; H01Q 1/12; H01Q 1/24
See application file for complete search history.

(56) References Cited

U.S. PATENT DOCUMENTS 4,761,656 A * 8/1988 Cosman ..... H01Q 1/40 340/571
8,800,880 B2 * 8/2014 Christiansen ..... E21B 17/006 235/385

(Continued)

FOREIGN PATENT DOCUMENTS

EP 1 801 293 6/2007
GB 2 326 002 12/1998

(Continued)

OTHER PUBLICATIONS 690-6000 MHz Base Station Antennas and Antenna Line Products (Kathrein Werke 2016).

(Continued)

*Primary Examiner* — Hoang V Nguyen
(74) *Attorney, Agent, or Firm* — Nixon & Vanderhye, P.C.

(57) ABSTRACT

A shaft antenna system for mobile communication comprises an antenna housing into which at least one antenna is introduced or can be introduced. A support frame has an insertion opening and a circumferential wall by which a receptacle space is bounded. The receptacle space is accessible from the insertion opening, and the antenna housing is arranged in the receptacle space. A termination cover assembly closes off the insertion opening. The termination cover assembly is supported at its edge region at least indirectly on the support frame. An underside of the termination cover assembly covers an upper side of the antenna housing. The antenna housing is supported at least indirectly on the support frame via at least one force storage device. The force storage device comprises at least one foam module which has elastic, resilient and damping properties, to hold the upper side of the antenna housing is pressed against the underside of the termination cover assembly.

17 Claims, 4 Drawing Sheets

(56) References Cited

U.S. PATENT DOCUMENTS

| | | | | |
|---|---|---|---|---|
| 2003/0085844 | A1* | 5/2003 | Olson | H01Q 1/04 343/749 |
| 2012/0293339 | A1 | 11/2012 | Milon et al. | |
| 2016/0380344 | A1* | 12/2016 | Eberly | H01Q 1/42 343/872 |

FOREIGN PATENT DOCUMENTS

| | | |
|---|---|---|
| JP | 2003-142904 | 5/2003 |
| JP | 2011-042943 | 3/2011 |

OTHER PUBLICATIONS

"Kathrein USA Meets Austin Texas" (Feb. 6, 2016).
"Catalog Download", Kathrein USA (2019) https://www.kathreinusa.com/catalog-download/.
"Download our Catalog", Kathrein USA (Jul. 15, 2016) https://web.archive.org/web/20160715162638/https://www.kathreinusa.com/catalog-download/.
International Search Report and Written Opinion of the ISA for PCT/EP2017/053202, dated Apr. 13, 2017, 14 pages.

* cited by examiner

SHAFT ANTENNA SYSTEM FOR MOBILE COMMUNICATION

This application is the U.S. national phase of International Application No. PCT/EP2017/053202 filed Feb. 14, 2017 which designated the U.S. and claims priority to DE 20 2016 100 765.8 filed Feb. 15, 2016, the entire contents of each of which are hereby incorporated by reference.

This invention describes a shaft antenna system for mobile communication. Shaft antennas are often used where normal antennas cannot be used because this spoils the look of the landscape. This relates in particular to city centers, where regulations prohibit the use of mobile communications antennas that are visible from a distance. Shaft antennas are preferably built into the ground or carriageways, and achieve a considerable propagation range due to multiple reflection from the surrounding buildings.

GB 2 326 002 A discloses a shaft antenna of this type. The shaft antenna is inserted into a hole in the ground and is supplied with power and data by an underground supply line. Here, the antenna system is integrated in a housing, the surface of the housing being flush with the surface of the carriageway.

Another shaft antenna is known from EP 1 801 293 A2. The shaft antenna does not have its own housing, but instead it is arranged on the underside of an existing manhole cover.

A drawback of the shaft antennas from the prior art is that the antenna does not cover the area to be supplied as desired owing to tolerances in the individual components and vibrations are transmitted to the antenna system by loading on the manhole cover and/or on the antenna housing, as is caused by pedestrians or vehicles. Mechanical coupling of this type results in a significant reduction in the service life of the antenna.

The problem addressed by the invention is therefore that of providing a shaft antenna system which is arranged as close to ground level as possible and at the same time is better protected from vibrations originating from vehicles or pedestrians.

The problem is solved in relation to a shaft antenna system in accordance with the features specified in claim 1. Advantageous developments of the invention are set out in the dependent claims.

The shaft antenna system according to the invention comprises an antenna housing, into which at least one antenna is or can be introduced. It comprises a support frame comprising an insertion opening and a circumferential wall, which defines a receiving space which is accessible from the insertion opening and in which the antenna housing is arranged. In this case, a cover plate assembly closes the insertion opening, the cover plate assembly being supported at least indirectly on the support frame in the edge region thereof, such that a lower face of the cover plate assembly covers an upper face of the antenna housing. The antenna housing is supported at least indirectly on the support frame by means of at least one force storing device. The at least one force storing device comprises at least one foam module, which has elastic, resilient and damping properties, meaning that the upper face of the antenna housing is kept pressed against the lower face of the cover plate assembly. The force storing device ensures that the antenna housing is always arranged as close as possible to and with consistent spacing from the cover plate assembly, and that the desired region above the carriageway can be supplied. Loading caused by pedestrians or vehicles that leads to vibrations and oscillations is also absorbed and damped by the force storing device, which means that the service life of the antenna housing and of the entire shaft antenna system is increased.

The foam module is preferably an elastomer foam, which for example consists of or comprises microcellular rubber and/or polyurethane. Said module may also comprise memory foam. A foam module of this type may have open pores, which means that the individual pores within the foam modules are interconnected; alternatively, it may also have closed pores. A mixture of open pores and closed pores is also possible. The surface of the foam module may be rough, which increases the grip (coefficient of friction). In the simplest scenario, this would be the case if the individual pores were visible from the outside. The foam module may, however, also have a preferably smooth skin or surface, which reduces wear.

In a development of the shaft antenna system according to the invention, a region of the upper face of the antenna housing comprises a plurality of raised portions projecting towards the cover plate assembly, the antenna housing only coming into contact with the lower face of the cover plate assembly by means of the raised portions. The antennas of the antenna housing may be arranged in these raised portions, which means that said antennas are arranged particularly close to an upper face of the shaft antenna system.

Another embodiment of the shaft antenna system according to the invention provides that, when installed, the antenna housing is arranged so as to be rotation-proof but (solely) axially movable (i.e. along a vertical axis) relative to the support frame, or that the cover plate assembly is arranged so as to be rotation-proof relative to the support frame. This is therefore important because in particular the support frame is rigidly connected to the ground or masonry surrounding said frame, and cannot rotate or move when installed. Because the antenna housing is also arranged so as to be rotation-proof relative to the support frame, it is ensured that the same area is always covered.

The antenna housing is preferably dimensioned such that the main beam direction of the antennas is not in parallel with the street, but preferably transverse to the street, in particular at an angle of 45°. This ensures that the antenna signal is reflected by building facades, which achieves a very high range. This kind of coverage of the area to be supplied by the antenna housing is achieved by the antenna housing being positioned in a preselectable angular position relative to the support frame. This means that the angular position can be set either at specific intervals or continuously. An adjustable angular position could be continuously set if it were possible to rotate the antenna housing into any position relative to the support frame, with the antenna housing having to be fixed in position on the support frame by a clamped connection after the desired angle is reached, such that only axial movement would still be possible.

In order for it to be possible to set a specific angular position, in a development of the shaft antenna system according to the invention it is provided that the antenna housing comprises latching projections on its circumferential surface which are offset from one another in the circumferential direction. In the same way, the circumferential wall of the support frame comprises a plurality of latching recesses on its inner face which are offset from one another in the circumferential direction, at least one latching projection or each latching projection engaging in a latching recess. The reverse would of course also be possible. Depending on the spacing between the individual latching projections, or the individual latching recesses, the antenna housing can be oriented in specific angular positions relative to the support frame. In this case, it is also sufficient for the support frame to be inserted into the ground without a specific orientation. The antenna housing can be precisely oriented later, and can also be changed very easily at any time.

In another development of the shaft antenna system according to the invention, the antenna housing is supported indirectly on the support frame. In this case, the circumferential wall of the support frame comprises, on its inner face, radially inwardly projecting support portions, at least in regions, preferably in the form of a support flange. In this case, the shaft antenna system additionally comprises a suspension frame, which comprises a circumferential material portion to which a plurality of hook-shaped suspension elements are attached. The hook-shaped suspension elements (which are preferably L-shaped) each comprise an elongate first portion and a second portion extending transversely (preferably perpendicularly) thereto. In this case, the second portion of each hook-shaped suspension element rests on the support portion of the support frame, such that the circumferential material portion of the suspension frame is arranged in the receiving space so as to be preferably below the support portions. The antenna housing is then arranged in this suspension frame.

The support portions of the support frame may comprise a plurality of recesses, the second portion of each hook-shaped suspension element resting in this recess. The suspension frame can be rotated relative to the support frame such that the relevant hook-shaped suspension element engages in different recesses in different angular positions. This not only allows different angular positions to be set, but also protects against rotation between the suspension frame and the support frame at the same time. Additionally and alternatively, each suspension element could also be rigidly connected to the respective support portions of the support frame by a screw connection and/or an adhesive connection.

A particular angular position could also be set by the antenna housing comprising latching projections on its circumferential surface which are offset from one another in the circumferential direction, at least the elongate first portion of each hook-shaped suspension element comprising a receiving slot extending at least over part of the length of the first portion. A latching projection of the antenna housing would then engage in said receiving slot. Alternatively, it would also be possible for the latching projections to be formed on the hook-shaped suspension elements, while latching recesses corresponding thereto are formed on the antenna housing.

Various embodiments of the invention are described in the following by way of example with reference to the drawings. Identical elements bear the same reference signs. Specifically, in the corresponding figures of the drawings.

Figure 1:
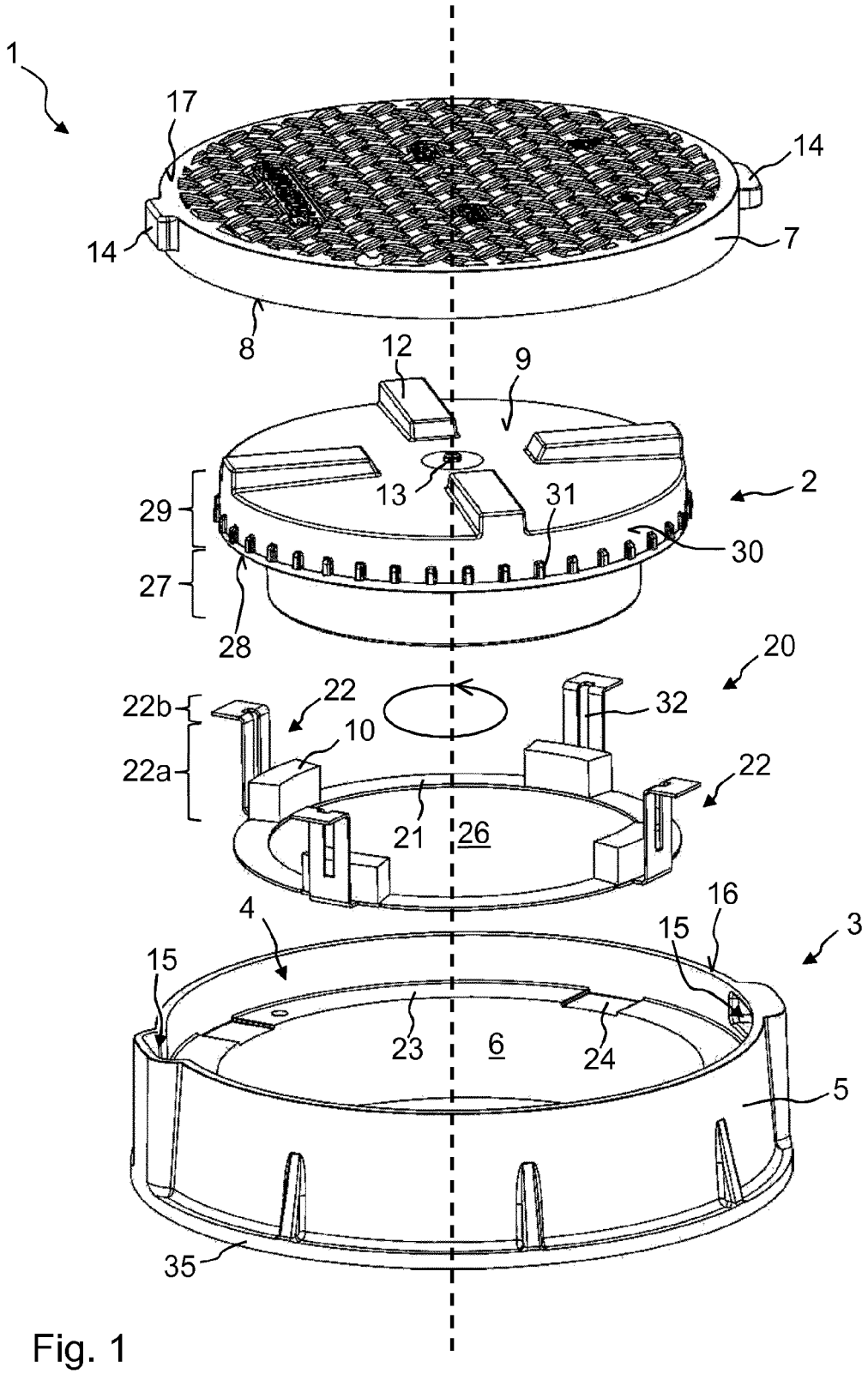
FIGS. 1 and 2 are exploded views of different embodiments of the shaft antenna system according to the invention.

FIG. 1 shows an embodiment of the shaft antenna system 1 according to the invention, which is suitable for mobile communication. The shaft antenna system is used in particular to provide mobile services along streets, pedestrian areas or in tunnels. In this case, services such as GSM, UMTS and LTE, inter alia, are provided.

In this case, the shaft antenna system 1 is preferably sunk into the ground. It comprises an antenna housing 2, into which at least one antenna is introduced. Furthermore, the shaft antenna system 1 comprises a support frame 3 comprising an insertion opening 4 and a circumferential wall 5, which defines a receiving space 6 which is accessible from the insertion opening 4 and in which the antenna housing 2 is arranged.

The shaft antenna system 1 also comprises a cover plate assembly 7, which closes the insertion opening 4, the cover plate assembly 7 being supported at least indirectly on the support frame 3 in the edge region thereof, such that a lower face 8 of the cover plate assembly 7 covers an upper face 9 of the antenna housing 2.

As explained in greater detail below, the antenna housing 2 is supported at least indirectly on the support frame 3 by means of a force storing device 10. The at least one force storing device 10 is designed such that it presses the upper face 9 of the antenna housing 2 against the lower face 8 of the cover plate assembly 7. The force storing device 10 therefore continually applies a preferably constant pressing force to the antenna housing 2, so that said housing is continually in mechanical contact with the cover plate assembly 7. This is preferably the case even when vehicles drive over the cover plate assembly 7.

By way of illustration, FIG. 1 also shows a vertical axis 11, which preferably passes through the center of the shaft antenna system 1. The antenna housing 2 and the cover plate assembly 7 are preferably arranged so as to be continually in parallel, with a maximum of ±2°. This preferably also applies to the support frame 3.

In FIG. 1, the upper face 9 of the antenna housing 2 comprises a plurality of raised portions 12 projecting towards the cover plate assembly 7. The antenna housing 2 only comes into contact with the lower face 8 of the cover plate assembly 7 via these raised portions 12. The remaining region of the upper face 9 of the antenna housing 2, which does not form part of the raised portions 12, is spaced apart from the lower face 8 of the cover plate assembly 7. This remaining region is preferably inclined in one or more directions. Preferably, this remaining region slopes away from the center of the antenna housing towards the edge. This ensures that penetrating moisture, for example rain, does not collect on the upper face 9 of the antenna housing 2, but runs off. A preferably watertight pressure relief valve 13 is also arranged in the center of the antenna housing 2. The pressure relief valve 13 is used to equalize pressure due to fluctuations in the air pressure of the surroundings or due to temperature fluctuations. Air can flow both into and out of the antenna housing 2 through the pressure relief valve 13.

The raised portions 12 preferably extend from an edge region of the upper face 9 of the antenna housing 2 towards the center of the upper face of the antenna housing 2. The raised portions are spaced apart from the center of the upper face of the antenna housing 2. They therefore end with spacing from the center of the upper face 9 of the antenna housing 2. The raised portions 12 are preferably longer than they are wide. All the raised portions 12 are preferably identical. The individual raised portions 12 are spaced apart from one another and/or are arranged around the center. In FIG. 1, they are spaced apart from one another by approximately 90°. At least parts of one or more antennas are preferably arranged in the raised portions 12. The antennas therefore protrude over the remaining surface 9 of the antenna housing 2.

In FIG. 1, an arrow extending around the vertical axis 11 indicates that it is possible for the antenna housing 2 to be rotated depending on the desired beam direction of the main lobe. Once installed, the orientation should be maintained. For this reason, the antenna housing 2 is arranged so as to be rotation-proof but axially movable (i.e. along the vertical axis 11) relative to the support frame 3. Preferably, the same also applies to the cover plate assembly 7. Said assembly is likewise arranged so as to be rotation-proof relative to the support frame 3. For this purpose, the cover plate assembly 7 comprises tabs 14 arranged on the circumferential surface of the cover plate assembly 7. Said tabs 14 engage in corresponding openings 15 arranged in the support frame 3. Said openings may be accessible from two directions, or from just one direction. In the latter case, this is what is known as a tunnel opening 15 that prevents the cover plate assembly 7 from being lifted off the support frame 3 solely by axial movement along the vertical axis 11.

The circumferential wall 5 of the support frame 3 is inclined radially inwards towards the cover plate assembly 7, relative to the outside thereof. As a result, the support frame 3 is prevented from being pulled out of the ground. An end face 16 of the circumferential wall 5 is flush with an upper face 17 of the cover plate assembly 7. The upper face 17 of the cover plate assembly 7 is preferably likewise flush with the carriageway.

The antenna housing 2 is supported on the support frame 3. In FIG. 1, the antenna housing 2 is only indirectly supported on the support frame 3. This is achieved by the antenna housing 2 being arranged on a suspension frame 20, or being retained thereby. The suspension frame 20 comprises a circumferential material portion 21 and a plurality of hook-shaped suspension elements 22 attached thereto. The hook-shaped suspension elements 22 each comprise an elongate first portion 22*a* and a second portion 22*b* extending transversely thereto.

The second portion 22*b* of the hook-shaped suspension elements 22 is supported on the support frame 3. For this purpose, the circumferential wall 5 of the support frame 3 comprises, on its inner face, radially inwardly projecting support portions 23, at least in regions. This means that the circumferential wall 5 comprises a first region and a second region, the second region having a smaller internal diameter than the first region, and being further away from the cover plate assembly 7 than the first region. The support portions 23 are formed on the second region. The second portion 22*b* of each hook-shaped suspension element 22 rests on the support portions 23 of the support frame 3. The second portion 22*b* is arranged at a first end of the first portion 22*a*. A second end of the first portion 22*a*, which is opposite the first end, is connected to the circumferential material portion 21. This means that the circumferential material portion 21 of the suspension frame 20 is arranged in the receiving space 6 so as to be preferably below the support portions 23.

In the position in which the second portion 22*b* of each hook-shaped suspension element 22 rests on the relevant support portion 23 of the support frame 3, the support portions 23 preferably comprise a recess 24 which prevents the suspension frame 20 from rotating relative to the support frame 3. Preferably, there is a plurality of recesses 24 such that it can be chosen which hook-shaped suspension element 22 is inserted into which recess 24. As a result, the antenna housing 2 is positioned in a preselectable angular position relative to the support frame 3. Preferably, there may be the same quantity of recesses 24 as hook-shaped suspension elements 22, or there may be more recesses than suspension elements.

The antenna housing 2 comprises latching projections 31 on its circumferential surface 30 which are offset from one another in the circumferential direction. The latching projections 31 are preferably formed in the upper part 29 of the antenna housing 2. Furthermore, at least the elongate first portion 22*a* of each hook-shaped suspension element 22 comprises a receiving slot 32 extending at least over part of the length of the first portion 22*a*. It may also extend over the entire length of the first portion 22*a*. In FIG. 1, said receiving slot 32 also extends into the second portion 22*b* to a certain extent. A latching projection of the antenna housing 2 engages in said receiving slot 32 and is solely axially guided thereby, i.e. along the vertical axis 11, which prevents the antenna housing 2 from rotating relative to the suspension frame 20. If the receiving slot 32 only extends over part of the length of the first portion 22*a*, the end of the receiving slot 32 that is closer to the circumferential material portion 21 simultaneously acts as a stop. As a result, any possible damage to the at least one force storing device 10 or the antenna housing 2, and thus to the shaft antenna system 1, is prevented.

The greater the number of latching projections 31 which are offset from one another in the circumferential direction, the more precisely the antenna housing 2 can be positioned relative to the suspension frame 20 and thus to the support frame 3. Preferably, the spacing between the individual latching projections 31 is constant. The preselectable angular position, which can preferably be set at specific intervals, may be in the range of at least 3°, preferably at least 5°, 7.5° and in particular at least 10° and/or less than 24° (preferably less than 20°, 18° and in particular less than 15°).

Of course, it would also be possible for the latching projections 31 to be attached to the hook-shaped suspension elements 22 and to each engage in one latching recess, which is formed on the circumferential surface 30 of the antenna housing 2. Said projections would likewise be offset from one another in the circumferential direction.

The force storing device 10 is dimensioned such that, when the shaft antenna system 1 is installed, the antenna housing 2 is permanently pushed or pressed against the lower face 8 of the cover plate assembly 7. The force applied by the force storing device 10 in order to press the antenna housing 2 towards the cover plate assembly 7 has to be such that it is greater than the force acting through the antenna housing 2 and the cables connected thereto in the downward direction. The pressing force with which the antenna housing 2 needs to be pressed against the lower face 8 of the cover plate assembly 7 is therefore greater than a threshold value. Said force is in the order of magnitude of at least 1 N, preferably of at least 5 N, 8 N, 12 N, 15 N and in particular at least 20 N and/or is preferably less than 80 N, preferably less than 60 N, 50 N, 30 N and in particular less than 25 N.

The antenna housing 2 preferably has a circular or predominantly circular cross section. The same also applies to the support frame 3, and in particular to the inner wall thereof. The circumferential material portion 21 of the suspension frame 20 has a substantially circular cross section. Other cross-sectional shapes would also conceivable, however.

The cover plate assembly 7 is screwed to the support frame 3 by means of a screw connection. Forces acting on the cover plate assembly 7 are therefore predominantly conducted into the support frame 3. The force storing device 10 is also used to damp vibrations caused by vehicles or pedestrians that step on or drive over the cover plate assembly 7.

The suspension frame 20 is formed in one piece, with the exception of the force storing device 10. The support frame 3 is preferably also formed in one piece.

The support frame 3 can be closed by a base 35 positioned opposite the insertion opening 4. The force storing device 10, or an additional force storing device, which presses the antenna housing 2 towards the cover plate assembly 7, may be arranged on the base 35 within the support frame 3. Latching projections 31 are not absolutely essential.

The cover plate assembly 7 may be formed in one piece or multiple pieces. Preferably, both the cover plate assembly 7 and the antenna housing 2, as well as the suspension frame 20 and the support frame 3, consist of a dielectric, in particular a plastics material. The antenna housing 2 preferably is watertight.

The force storing device 10 consists of a foam module that has elastic, resilient and/or damping properties. The foam module is preferably an elastomer foam. Said foam module preferably comprises or consists of microcellular rubber and/or polyurethane. There are preferably the same amount of force storing devices 10 as hook-shaped suspension elements 22. The force storing devices 10 are arranged at the point on the circumferential material portion 21 at which the hook-shaped suspension elements 22 and the second end of the first portion 22*a* are also arranged. There may, however, also be more or fewer force storing devices 10 than hook-shaped suspension elements 22. These may also be arranged at any point on the circumferential material portion 21. Preferably, the force storing devices 10 are, however, arranged symmetrically on the circumferential material portion 21. This means that the spacing between the individual force storing devices 10 is constant.

In this embodiment, the force storing devices 10 in the form of foam modules have a curvature that approximately corresponds to the curvature of the circumferential material portion 21. They are also approximately the same width as the circumferential material portion 21. The height of the foam modules 10 is then selected according to the weight of the antenna housing 2 together with the associated cabling and according to how high the pressing force on the lower face 8 of the cover plate assembly 7 needs to be. The same also applies to the question of whether foam modules are intended to have open pores or closed pores, and whether they should optionally also have a protective covering.

Figure 2:
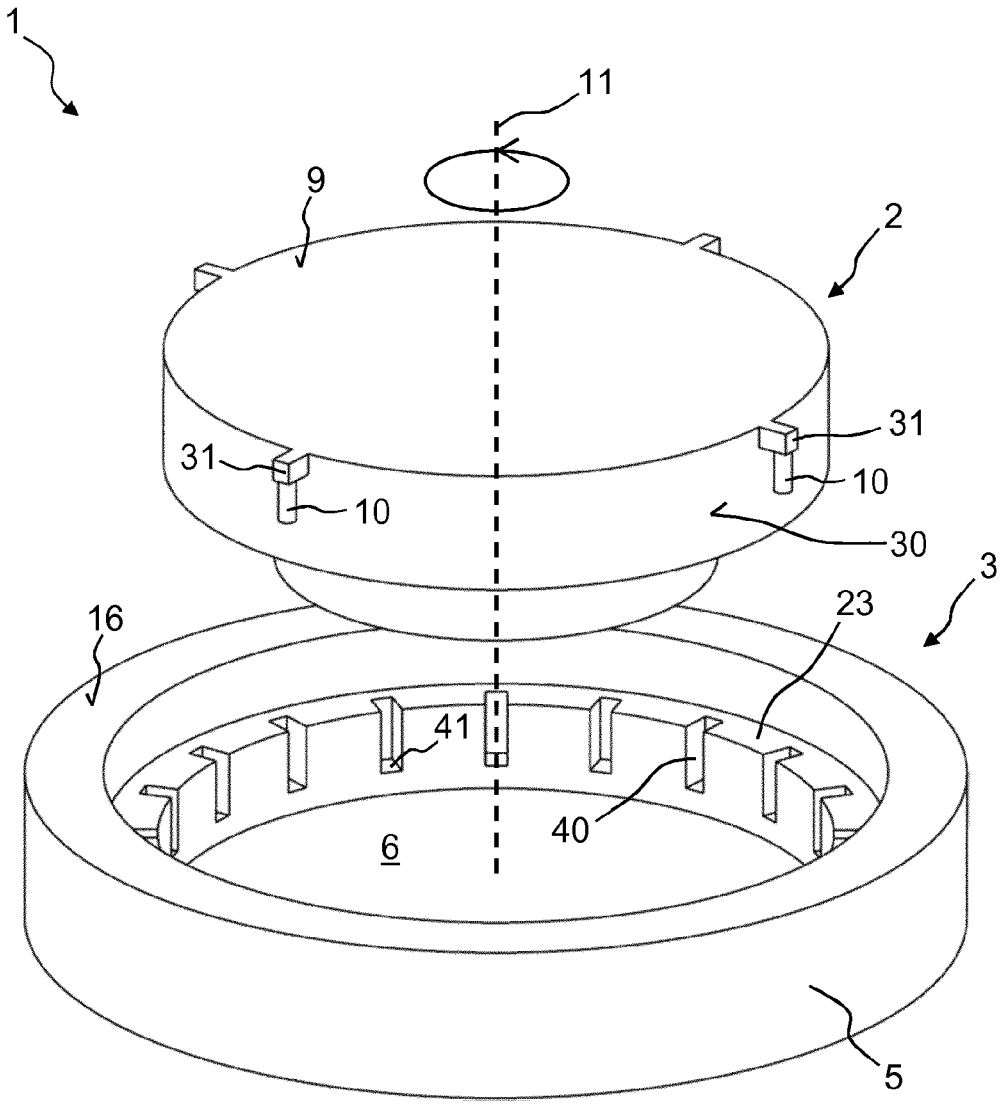

FIG. 2 shows another embodiment of the shaft antenna system 1 according to the invention. By contrast with the preceding embodiments, in this embodiment a suspension frame 20 has not been used. Instead, the shaft antenna system 1 merely consists of the support frame 3, the antenna housing 2 and a cover plate assembly 7 (not shown in FIG. 2). In this embodiment, the antenna housing 2 is supported directly on the support frame 3. The circumferential wall 5 of the support frame 3 comprises a plurality of latching recesses 40 on its inner face which are offset from one another in the circumferential direction. Said recesses are preferably made in the support portions 23 which the circumferential wall 5 comprises. Said support portions 23 project radially inwardly from the inner face of the circumferential wall 5. In FIG. 2, the support portions 23 are one continuous flange. Said flange is spaced apart from the end face 16 of the support frame 3. The latching recesses 40 do not penetrate the support portions 23 over their entire length, but only over part of their length, meaning that a support shoulder 41 is formed. The spacing between the individual latching recesses 40 is preferably constant. The more latching recesses 40 that are made, the more precisely the angular position between the support frame 3 and the antenna housing 2 can be set, i.e. rotated.

The antenna housing 2 comprises latching projections 31 on its circumferential surface 30 which are offset from one another in the circumferential direction. Preferably, each of these latching projections 31 engages in a latching recess 40.

At least two of these latching projections 31 are connected to one force storing device 10 in each case. In this case, the force storing device 10 is the foam module. Preferably, all the latching projections 31 that engage in a latching recess 40 are connected to a force storing device 10. This means that the force storing device 10 is arranged between the latching projection 31 and the latching recess 40, and is supported on the support shoulder 41 of the latching recess 40. As a result, the antenna housing 2 is supported on the support frame 3 and is pressed towards the cover plate assembly 7. The single force storing device 10, or an additional force storing device, which presses the antenna housing 2 towards the cover plate assembly 7, could also be arranged on a base 35 of the portion frame 3.

Conversely, it would of course also be possible for the support frame 3 to comprise a plurality of latching projections 31 which are offset from one another in the circumferential direction, the antenna housing 2 in this case comprising a plurality of latching recesses 40 on its circumferential surface 30 which are offset from one another in the circumferential direction, each latching projection 31 preferably likewise engaging in a latching recess 40.

Figure 3:
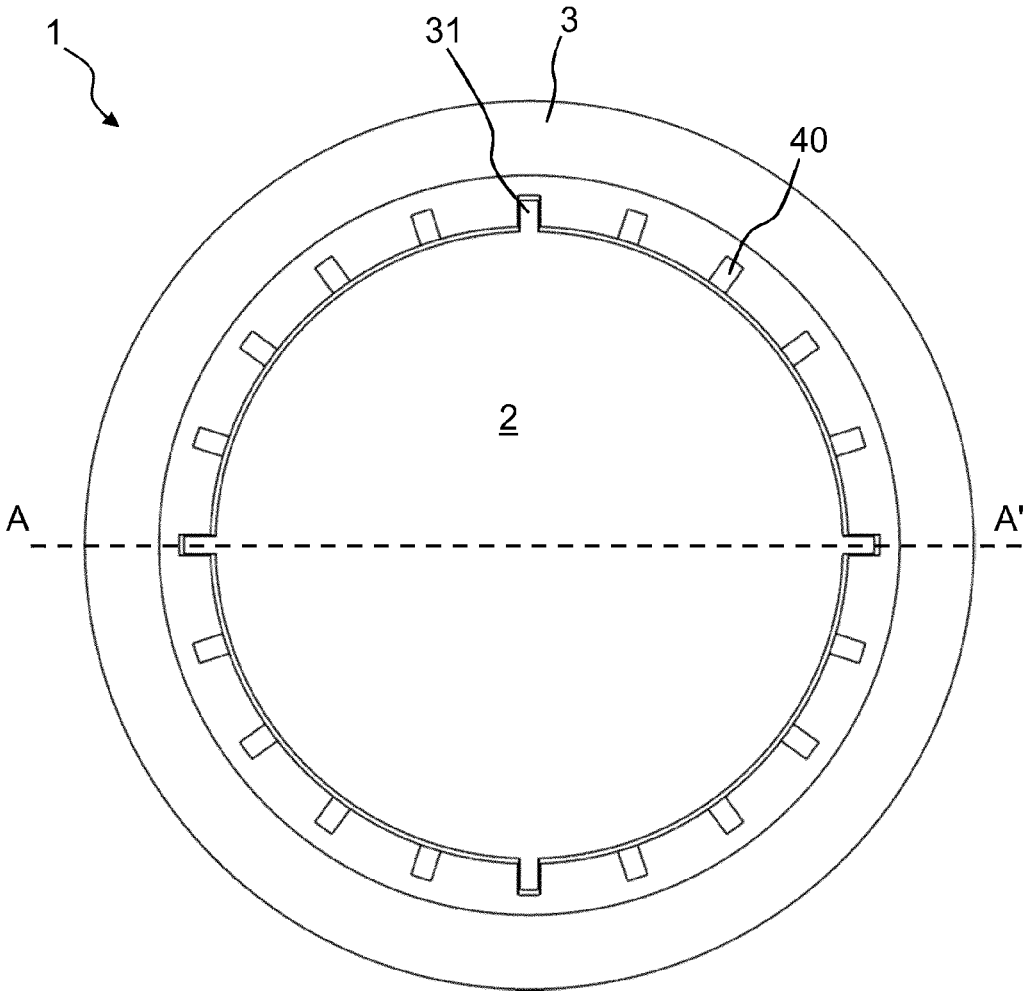
FIG. 3 is a plan view of the shaft antenna system from FIG. 2.

FIG. 3 is a plan view of the shaft antenna system from FIG. 2, with the cover plate assembly 7 removed. The antenna housing 2 comprises four latching projections 31 that each engage in a latching recess 40. The other latching recesses 41 are not in engagement with a latching projection 31.

Figure 4:
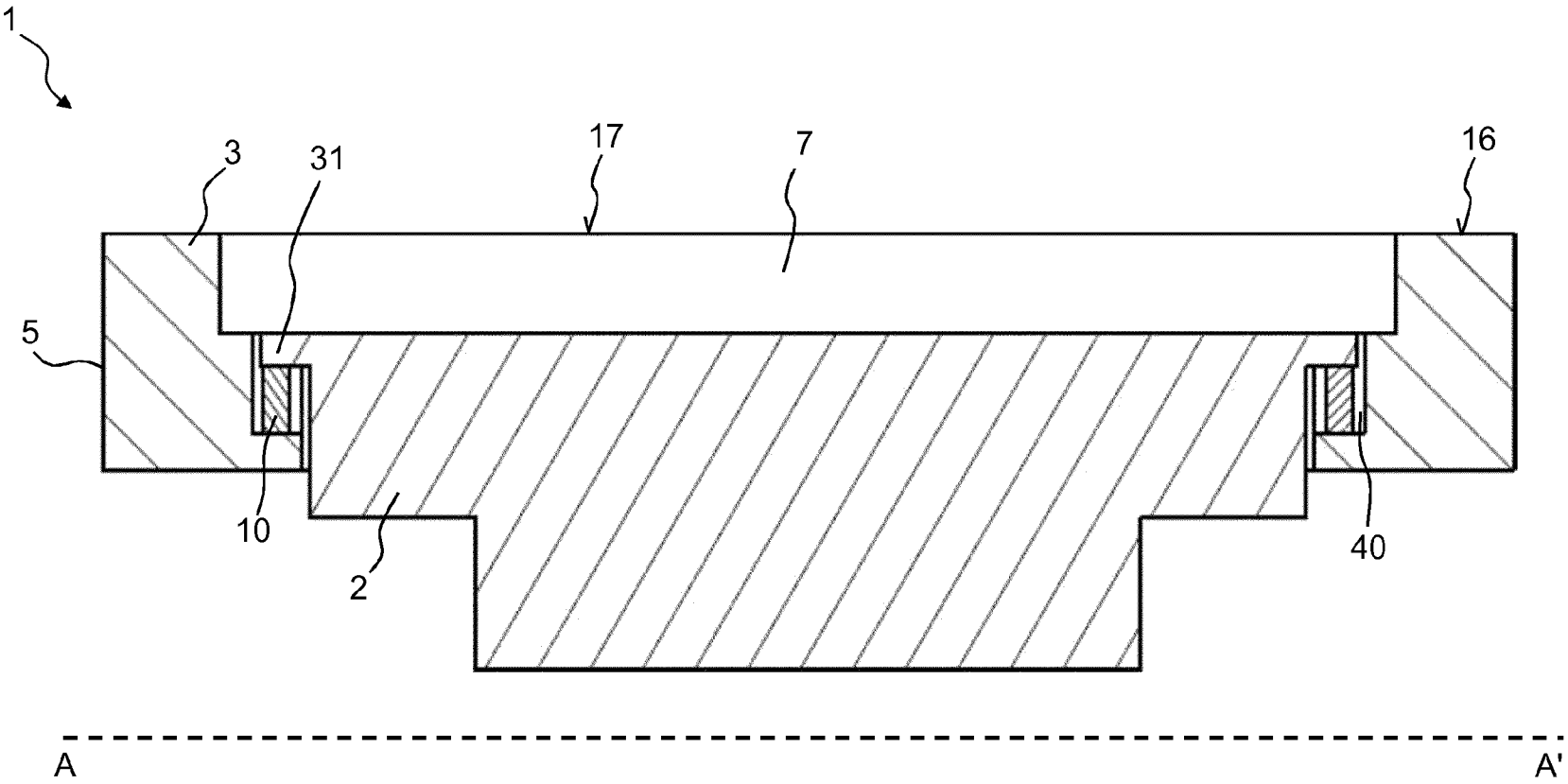
FIG. 4 is a longitudinal section through the shaft antenna system according to the invention from FIG. 2.

FIG. 4 is a longitudinal section through the shaft antenna system 1 according to the invention from FIG. 2, along line A-A (shown in FIG. 3). The support frame 3 is shorter than the antenna housing 2. The antenna housing 2 rests in the latching recess 40 and on the support shoulder 41, by means of a force storing device 10. A lower face, in particular the lower part 27 but also part of the upper part 29, is positioned below the support frame 3, or shows through the portion frame at an outlet opening that is opposite the insertion opening 4. This means that the antenna housing 2 has a determining influence on the overall height of the shaft antenna system 1. The antenna housing 2 is therefore not completely surrounded by the support frame 3 and the cover plate assembly 7. In this case, the cover plate assembly 7 rests on the support shoulder 23 and is flush with the end face 16 of the support frame 3.

The shaft antenna system 1 according to the invention also solves the stated problem if the force storing device (in the form of a foam module) is only found in one development; in this case, the shaft antenna system 1 according to the invention has the feature whereby the antenna housing 2 is positioned in a preselectable angular position relative to the support frame 3.

Lastly, it is also noted that the shaft antenna system 1 explained can be arranged and installed, in particular underground, both in roads and on paths or in parks. However, it is also possible to install the shaft antenna system 1 in tunnels, on bridges or in buildings. In this case, the invention primarily provides significant advantages in places where it is necessary to decouple vibrations and to reduce or prevent compressive loads on the antenna housing. This applies both to road vibrations and to vibrations in buildings.

The invention is not limited to the embodiments described. Within the scope of the invention, all the features described and/or illustrated can be combined with one another as desired.

The invention claimed is:

1. Shaft antenna system for mobile communication, comprising:

an antenna housing, into which at least one antenna is or can be introduced;

a support frame comprising an insertion opening and a circumferential wall, which defines a receiving space which is accessible from the insertion opening and in which the antenna housing is arranged;

a cover plate assembly, which closes the insertion opening, the cover plate assembly being supported at least indirectly on the support frame in an edge region thereof, such that a lower face of the cover plate assembly covers an upper face of the antenna housing;

the antenna housing being supported at least indirectly on the support frame by at least one force storing device;

the at least one force storing device comprising at least one foam module, which has elastic, resilient and damping properties that keep the upper face of the antenna housing pressed against the lower face of the cover plate assembly;

the at least one force storing device pressing the upper face of the antenna housing against the lower face of the cover plate assembly with a pressing force that is (a) greater than a threshold value, and/or (b) in the order of magnitude of at least 1 N and/or in an order of magnitude of less than 80 N.

2. Shaft antenna system according to claim 1, wherein:

the foam module is an elastomer foam; and/or the foam module comprises or consists of microcellular rubber and/or polyurethane.

3. Shaft antenna system according to claim 1, wherein:

when installed, the antenna housing is arranged so as to be rotation-proof but axially movable relative to the support frame; and/or the cover plate assembly is arranged so as to be rotation-proof relative to the support frame and/or is screwed thereto.

4. Shaft antenna system for mobile communication, comprising:

an antenna housing, into which at least one antenna is or can be introduced;

a support frame comprising an insertion opening and a circumferential wall, which defines a receiving space which is accessible from the insertion opening and in which the antenna housing is arranged;

a cover plate assembly, which closes the insertion opening, the cover plate assembly being supported at least indirectly on the support frame in an edge region thereof, such that a lower face of the cover plate assembly covers an upper face of the antenna housing;

the antenna housing being supported at least indirectly on the support frame by at least one force storing device;

the at least one force storing device comprising at least one foam module, which has elastic, resilient and damping properties that keep the upper face of the antenna housing pressed against the lower face of the cover plate assembly, wherein:

a region of the upper face of the antenna housing comprises a plurality of raised portions projecting towards the cover plate assembly, the raised portions coming into contact with the lower face of the cover plate assembly; and the remaining region of the upper face of the antenna housing, which is spaced apart from the lower face of the cover plate assembly, is inclined in one or more directions, so as to slope towards the circumferential edge thereof.

5. Shaft antenna system according to claim 4, wherein:

when installed, the antenna housing is arranged so as to be rotation-proof but axially movable relative to the support frame; and/or the cover plate assembly is arranged so as to be rotation-proof relative to the support frame and/or is screwed thereto.

6. Shaft antenna system according to claim 4, wherein:

the antenna housing is positioned in a preselectable angular position relative to the support frame.

7. Shaft antenna system according to claim 4, wherein:

the foam module is an elastomer foam; and/or the foam module comprises or consists of microcellular rubber and/or polyurethane.

8. Shaft antenna system, for mobile communication, comprising:

an antenna housing into which at least one antenna is or can be introduced;

a support frame comprising an insertion opening and a circumferential wall, which defines a receiving space which is accessible from the insertion opening and in which the antenna housing is arranged, the antenna housing positioned in a preselectable angular position relative to the support frame, wherein the preselectable angular position can be set at specific intervals or continuously; and the preselectable angular position specific intervals are in the range of at least 3°, and/or less than 24°; and a cover plate assembly, which closes the insertion opening, the cover plate assembly being supported at least indirectly on the support frame in an edge region thereof, such that a lower face of the cover plate assembly covers an upper face of the antenna housing;

the antenna housing being supported at least indirectly on the support frame by at least one force storing device.

9. Shaft antenna system according to claim 8, wherein:

a) the antenna housing comprises latching projections on a its circumferential surface thereof which are offset from one another in the circumferential direction;

the circumferential wall of the support frame comprises a plurality of latching recesses on its inner face which are offset from one another in the circumferential direction, at least one latching projection or each latching projection engaging in a latching recess;

or b) the circumferential wall of the support frame comprises a plurality of latching recesses that are offset from one another in the circumferential direction; and the antenna housing comprises a plurality of latching recesses on a circumferential surface thereof which are offset from one another in the circumferential direction, at least one latching projection or each latching projection engaging in a latching recess.

10. Shaft antenna system according to claim 8, wherein:

a) at least two force storing devices are provided, one of the at least two force storing devices being arranged in a latching recess and the at least one other force storing device being arranged in the at least one other latching recess, in each of which one latching projection engages, which means that the antenna housing is supported on the support frame and is pressed towards the cover plate assembly; and/or b) the support frame comprises a base, the at least one force storing device being arranged between the base of the support frame and a lower face of the antenna housing, which means that the antenna housing is supported on the support frame and is pressed towards the cover plate assembly.

11. Shaft antenna system according to claim 8, wherein:

the circumferential wall of the support frame comprises, on an inner face thereof, radially inwardly projecting support portions, at least in regions;

a suspension frame is provided which comprises a circumferential material portion and a plurality of hook-shaped suspension elements attached thereto;

the hook-shaped suspension elements each comprise an elongate first portion and a second portion extending transversely thereto;

the second portion of each hook-shaped suspension element rests on the support portions of the support frame, such that the circumferential material portion of the suspension frame is arranged in the receiving space so as to be predominantly below the support portions; and the antenna housing is arranged in the suspension frame.

12. Shaft antenna system according to claim 11, wherein:

in the position in which the second portion of each hook-shaped suspension element of the suspension frame rests on the relevant support portion of the support frame, the support portions comprise a recess which prevents the suspension frame from rotating relative to the support frame; and/or the second portion of each hook-shaped suspension element of the suspension frame is rigidly connected to the respective support portions of the support frame by means of a screw connection, which prevents the suspension frame from rotating relative to the support frame.

13. Shaft antenna system according to claim 12, wherein:

the hook-shaped suspension element is arranged at any recess, which means that the antenna housing is positioned in a preselectable angular position relative to the support frame.

14. Shaft antenna system according to claim 11, wherein:

a) the antenna housing comprises latching projections on a circumferential surface thereof which are offset from one another in the circumferential direction;

at least the elongate first portion of each hook-shaped suspension element of the suspension frame comprises a receiving slot extending at least over part of the length of the first portion;

a latching projection of the antenna housing engages in said receiving slot and is axially guided thereby, which prevents the antenna housing from rotating relative to the suspension frame;

or b) the antenna housing comprises latching recesses on a circumferential surface thereof which are offset from one another in the circumferential direction;

at least one hook-shaped suspension element of the suspension frame comprises at least one latching projection, which engages in a latching recess and is axially guided thereby, which prevents the antenna housing from rotating relative to the suspension frame.

15. Shaft antenna system according to claim 11, wherein:

at least one force storing device is arranged between the circumferential material portion of the suspension frame and the antenna housing, which means that the antenna housing is supported indirectly on the support frame by the suspension frame and is pressed towards the cover plate assembly.

16. Shaft antenna system according to claim 8, wherein:

the foam module is an elastomer foam; and/or the foam module comprises or consists of microcellular rubber and/or polyurethane.

17. Shaft antenna system according to claim 8 wherein the at least one force storing device comprises at least one foam module, which has elastic, resilient and damping properties that keep the upper face of the antenna housing pressed against the lower face of the cover plate assembly.

* * * * *